United States Patent [19]

Swanson

[11] 4,189,140

[45] Feb. 19, 1980

[54] SHEET STACKING APPARATUS

[75] Inventor: Kermit E. Swanson, Naperville, Ill.

[73] Assignee: R.R. Donnelley & Sons Company, Chicago, Ill.

[21] Appl. No.: 900,899

[22] Filed: Apr. 28, 1978

[51] Int. Cl.[2] ..... B65H 31/08

[52] U.S. Cl. ..... 271/212; 271/197

[58] Field of Search ..... 271/212, 196, 197, 186; 214/6 BA

[56] References Cited

U.S. PATENT DOCUMENTS

| | | | |
|---|---|---|---|
| Re. 26,004 | 4/1966 | Hoffswell | 271/212 X |
| 2,772,880 | 4/1956 | Garrett | 271/197 |
| 2,867,438 | 1/1959 | Hori | 271/197 X |
| 2,987,314 | 6/1961 | Monaghan | 271/212 X |
| 3,781,005 | 12/1973 | Stobb | 271/212 X |
| 3,947,018 | 3/1976 | Stange | 271/197 X |

OTHER PUBLICATIONS

IBM Technical Disclosure Bulletin, vol. 12, No. 8, Jan. 1970, p. 1226, "Bottom Stacking Apparatus for Documents", Jurgens, Krause, and Newsom.

*Primary Examiner*—Richard A. Schacher

*Attorney, Agent, or Firm*—Wegner, Stellman, McCord, Wiles & Wood

[57] ABSTRACT

An apparatus for forming thin paper sheets or signatures into an upright stack first arranges said sheets on a generally horizontal endless belt conveyor in a shingled stream with the leading edge of each sheet beneath the immediately preceding sheet and the trailing edge portion of each sheet projecting behind the trailing edge of said preceding sheet, and moves said conveyor continuously forwardly to bring the sheets successively into abutment with a stop so the driving force of the conveyor causes a stack to form from the bottom. The endless belt conveyor has a perforate bet, and a vacuum system below the perforate belt draws the sheets constantly and firmly downwardly against said perforate belt in a part of the path which ends at the stop, so that each sheet is conveyed positively forwardly against the stop. In one form of the apparatus a driven feedroll bears upon and frictionally engages the projecting trailing edge portion of each sheet as it enters the stack to apply a feeding force which assists in driving each sheet against the stop.

6 Claims, 3 Drawing Figures

40
72
68
71
67
20
69
64
10
40a
70
35
24
37
38
79
12
57
58
73
34
65
76
21a
49
41
62
75
47
54
53
51
50
18
48
42
43
44
2.
17
25
21
52
26
13
23
16
59
55
3.
63
33
11
A 37a
79
78
77
26
73
75
21
74
71
16
12
18
19
45
46
38
37
72
50
52
41
43
13
27
10
17
40a
70
69
56
44
42
48
53a
28
39
30
68
67
31
65
66
20
A
60
62
29
35
24
23
64
63
32
34
36
33
22
58
59
61
57
15
14

37
25
26
19
45
46
38
12
50
53a
48
13
22
40a
53
56
52
40
41
28
17
16
27
22
29
15

SHEET STACKING APPARATUS

BACKGROUND OF THE INVENTION

The present invention is directed to stackers of the general type disclosed in Hoffswell U.S. Pat. No. Re. 26,004. The invention, in one of its forms, is an improvement upon the apparatus of the patent; while in another form it provides an alternative structure for performing the same function.

The patented stacker has proved to be one of the most efficient and reliable stackers yet devised for the stacking of signatures delivered from the outfeed of a high-speed rotary printing press and signature former. It is inexpensive, requires very little floor space, produces a stack of signatures from which lifts may readily be removed while the stacker continues to run, functions very efficiently with signatures on a wide variety of different kinds of paper and consisting of different numbers of pages, and is easily adjusted to stack signatures of various lengths and widths with equal facility.

The stacker of the patent, however, occasionally fails to form an entirely satisfactory stack of signatures printed on relatively lightweight stock, especially if they consist of only a small number of pages. The stacks are generally adequate, but sometimes are not as good as may be demanded in the highest quality of work because the signatures in a stack may not be sufficiently registered with one another from front to rear. Such problems may arise in stacking four to eight-page signatures printed on stock which is less than about 32 pounds, which tend to buckle from the force of the feedroll pushing on their projecting trailing end portions.

The problem has been more serious in recent years due to increasing use of lightweight stock to hold down printing costs.

SUMMARY OF THE INVENTION

In accordance with the present invention, at least one of the belts upon which the shingled stream of signatures is carried forwardly against the stop in the stacking area is perforate, and traverses the top of a vacuum box in the stacking area which causes the signatures in the shingled stream to be drawn firmly against the perforate belt as they are moved frowardly against the stop to form a stack in which the signatures are substantially perfectly aligned with one another from front to rear.

Where a vacuum belt is used as an improvement upon the apparatus of U.S. Pat. No. Re. 26,004, the suction upon the sheets in the shingled stream keeps them moving positively forwardly against the stop, rather than relying solely upon the force applied to the trailing end portion of each signature by the feedroll which is positioned one signature length downstream from the stop.

If it is known that a stacker is to be used only with signatures of relatively lightweight stock and consisting of only a small number of pages, then the cost of the machine can be reduced by eliminating the feedroll and its drive.

Vacuum belts are old and well known in the sheet conveying art (see U.S. Pat. No. 1,625,641), where the problem is solely one of keeping sheets in a fixed position relative to one another. They have never heretofore been used in a stacker of the type disclosed in U.S. Pat. No. Re. 26,004. It is surprising that vacuum belts are effective for the present purpose, because each signature trails the preceding one by only about 5/16 to 7/16 inch (about 80 to 112 mm); so only that much of the leading end portion of a signature is subject to the effect of the vacuum system as the signature approaches the stop. The feeding force on a particular signature, either from the vacuum belt alone or from the vacuum belt plus the feedroll, must be sufficient that when the signature next above it strikes the stop, the friction between the two signatures is overcome so the particular signature continues to be moved forward against the stop. The driving force required to accomplish this increases steadily as the height of a stack increases.

In addition to the fact that only a very narrow strip at the leading end of a signature is subject to the vacuum, each signature supports the entire signature above it except for that narrow strip; so there is a tendency even for that strip to be forced upwardly off the belt and break the suction on it. This is believed to be the reason that the vacuum belt conveyor can be used without the feedroll only for relatively thin signatures.

THE DRAWINGS

DETAILED DESCRIPTION OF THE INVENTION

The apparatus of the invention is seen to have outer, upright side frame members 10 and 11 and inner frame plates 12 which are connected by a cross member 13. The apparatus is supported partly upon a forward leg 14 and partly upon the frame of separate apparatus such as a web feeding, printing, folding and cutting machine the outfeed of which is indicated generally at A.

Figure 1:
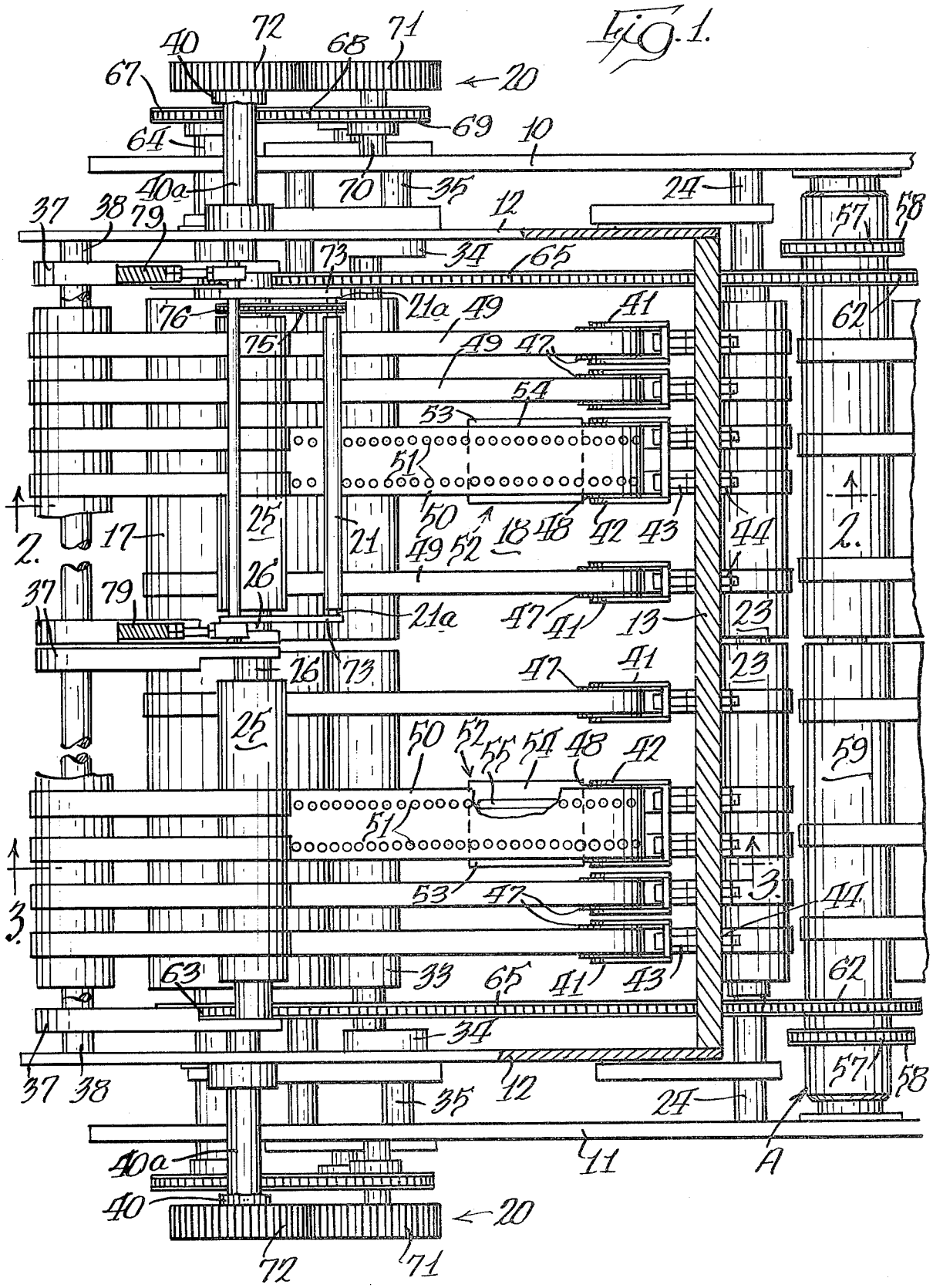
FIG. 1 is a plan view of a dual stream stacker embodying the invention, with the upper stream showing a vacuum belt used in conjunction with a feedroll, and with the lower stream illustrating the use of a vacuum belt in substitution for a feedroll, and with parts omitted for clarity.
Figure 2:
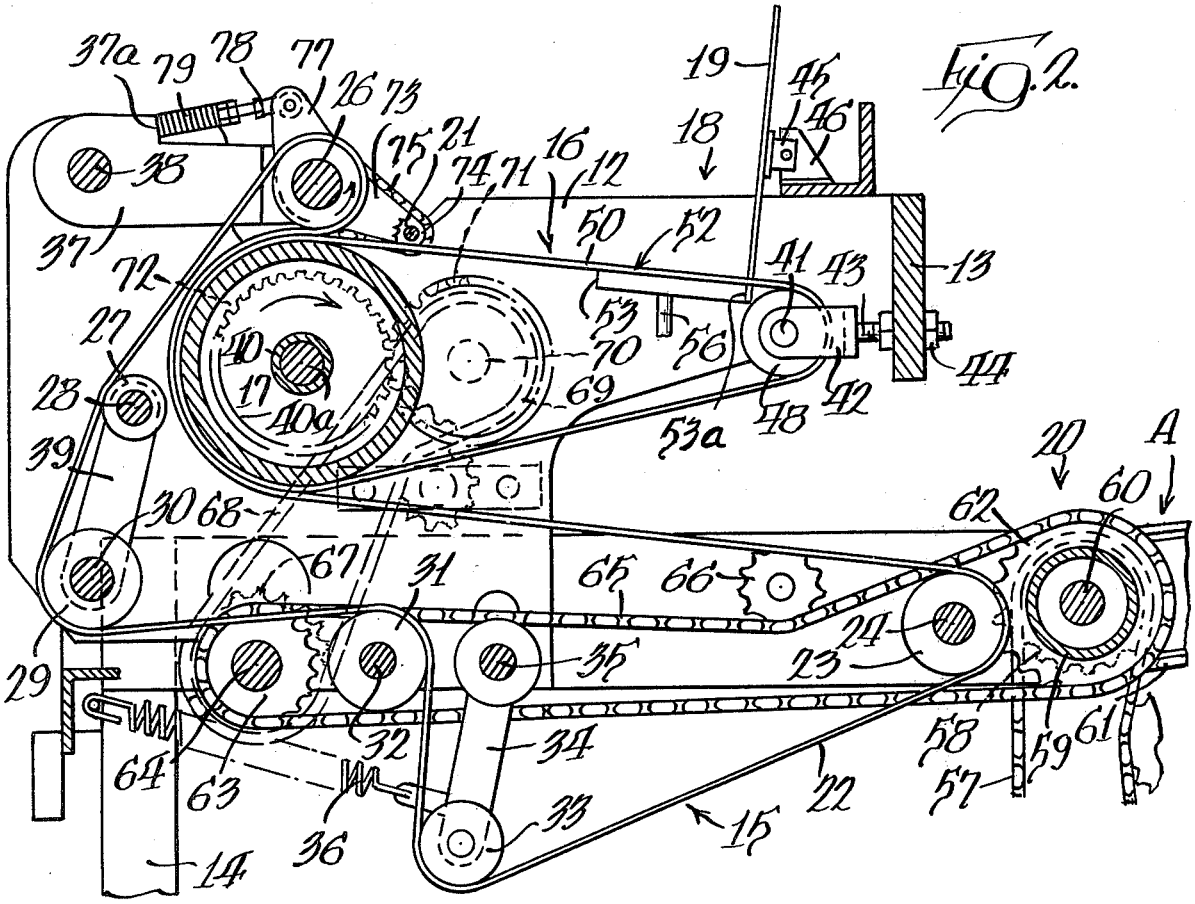
FIG. 2 is a fragmentary sectional view taken substantially as indicated along the line 2—2 of FIG. 1.

Referring now to FIG. 2, the apparatus includes, generally, a primary conveyor belt means 15 which receives a singled stream of signatures from the outfeed A, and which thereafter cooperates with stacking conveyor means, indicated generally at 16, to carry the signatures around a reversing drum 17 and into a stacking area 18 where they abut a stop 19. The unit illustrated in the drawings is seen in FIG. 1 to be of the dual type which handles two parallel streams of signatures. Each of the two stackers is independently driven by drive means, indicated generally at 20, which are at the two sides of the apparatus.

Since the two sides of the stacker are identical except for omission of a feedroll 21 (FIG. 2) and its drive, from the unit shown at the bottom of FIG. 1, the detailed description hereinafter will be based principally upon the showing at the upper part of FIG. 1 and in FIG. 2.

The primary conveyor means 15 consists of a plurality of parallel endless conveyor belts 22, the path of which is as follows:

Around a roller 23 journalled on a shaft 24, backwrapped around the belts of the stacking conveyor 16 and the rearward part of the reversing drum 17; around a roller 25 which is journalled on a shaft 26; over a small guide roller 27 which is journalled on a shaft 28; around a roller 29 which is journalled on a shaft 30; over a roller 31 which is journalled on a shaft 32; and around a release roller 33 which is rotatably mounted upon arms 34 which are pivoted upon mounting spindles 35. The arms 34 are biased rearwardly (to the left in FIG. 2) by tension springs 36, so that if material jams between the belts 22 and the belts of the stacking conveyor means 16, the arms 34 can swing counterclockwise as seen in FIG. 2 against the bias of the spring 36 to loosen the belts 22. For structural reasons, arms 37 which support the shaft 26 are carried upon structural rods 38; and arms 39 which support the shaft 30 are carried upon the shaft 28.

The stacking conveyor means 16 includes the reversing drum 17 which is keyed to a sleeve 40 that is journalled upon a fixed supporting shaft 40*a;* belt pulley yokes 41 and 42 which are individually adjustably mounted on the crossframe member 13 by bolts and nuts 43 and 44; narrow rollers 47 journalled in the yokes 41 and wide rollers 48 jounalled in the yokes 42; narrow conveyor belts 49 trained over the rollers 47 and around the drum 17; and a wide, perforate belt 50 which is trained around the roller 48 and around the drum 17 on the longitudinal median plane of a shingled stream of signatures which are carried upon the stacking conveyor means 16. The perforate belt 50 has parallel lines of vacuum holes 51. As previously indicated herein, each signature trails the preceding one by only about 5/16 to 7/16 inch (about 80–112 mm), so only that small leading end portion of each signature contacts the belts 49 and 50.

Figure 3:
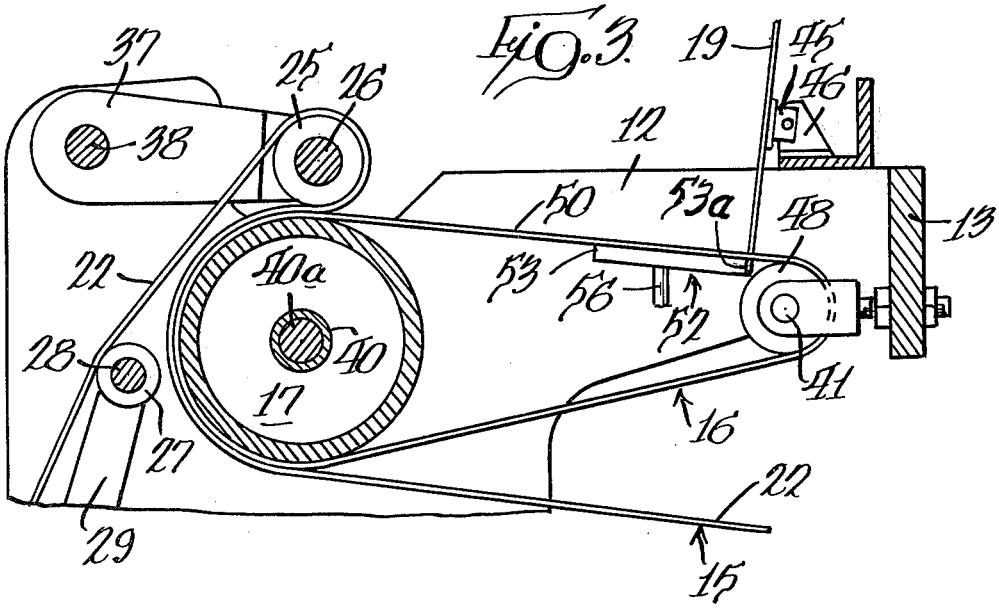
FIG. 3 is a fragmentary sectional view taken substantially as indicated along the line 3—3 of FIG. 1 with the entire lower part of the apparatus omitted since that is illustrated in FIG. 2.

A vacuum system, indicated generally at 52, includes a vacuum chamber 53 which is mounted beneath the perforate belt 50 and has a top plate 54 provided with an elongate slot 55 beneath each of the rows of holes 51 in the perforate belt 50. The vacuum chamber 53 is connected through a conduit 56 with a vacuum pump (not shown). The under side of perforate belt 50 rides upon the top plate 54 of the vacuum chamber 53 so that all the air entering the vacuum system must enter through the parallel lines of holes 51. As seen in FIGS. 2 and 3, the vacuum chambers 53 terminate at the stop 19 where they have downstream ends 53*a*.

As seen in FIGS. 2 and 3, the stop 19 has a bracket 45 by which it is supported on a base 46 which is adjustable toward and away from the vertical plane of the shaft 40 to permit the stacking of signatures having different fore-and-aft dimensions.

As seen in FIGS. 1 and 2, the drive for the apparatus comes from a drive chain 57 which is trained around a sprocket 58 that is keyed to a roller 59 journalled upon a shaft 60 which also carries belts 61 for the folding and cutting machine outfeed A, so that the latter are also driven by the chain 57. An output sprocket 62 on the roller 59 and an intermediate sprocket 67 on the shaft 64 carries a chain 68 which extends upwardly around a sprocket 69 keyed to a stub shaft 70; and a gear 71 on the stub shaft 70 meshes with a gear 72 on the outer end of the sleeve 40 to drive the reversing drum 17. This, of course, drives the stacking conveyor means 16; and the primary conveyor means is frictionally driven from the stacking conveyor means.

Referring now to FIG. 2 and the unit illustrated in the upper part of FIG. 1, the final feedroll 21 has end portions 21*a* of reduced diameter which are journalled in first bell crank arms 73 that are pivotally mounted upon the shaft 26; and a sprocket 74 on one of the reduced end portions 21*a* of the final feedroll receives a chain 75 which is trained around a sprocket 76 pinned to the end of the roller 25 so that the final feedroll 21 is driven with the primary conveyor means15 and rotates in the same direction as the roller 25. Second bell crank arms 77 receive spring supports 7, and compression springs 79 between the spring support 78 and shoulder 37*a* on the arms 37 urge the final feedroll 21 firmly against the signatures in the shingled stream.

As previously indicated, the final feedroll 21, its mounting arms and its drive means are omitted from the unit illustrated in FIG. 3 and in the lower part of FIG. 1.

The present stacker builds a stack by butting the leading edges of the signatures in the shingled stream successively against the stop 19 so that the stack builds upwardly from the bottom. In operation, the suction from the box 53 acts on the short leading end portion of each signature, which as previously stated in the Summary of the Invention is only about 5/16 to 7/16 inch (about 80–112 mm)—i.e., the distance from the leading edge of any signature to the leading edge of the next succeeding signature. That portion of each signature is thus subjected to a strong conveying force as long as it is above the vacuum box 53. When the leading edge of a signature strikes the stop 19, the leading edge portion is rapidly released from the conveying force as the leading edge of the next succeeding sheet is advanced beneath said leading end portion and against the stop 19.

The foregoing detailed description is given for clearness of understanding only and no unnecessary limitations should be understood therefrom as modifications will be obvious to those skilled in the art.

I claim:

1. Apparatus for stacking limp paper sheets with their end edges in generally upright approximate alignment, said apparatus comprising in combination:

generally horizontal endless stacking conveyor means for effectively constantly and completely supporting and moving shingled sheets in a path;

means for continuously forming limp paper sheets into a shingled stream on said stacking conveyor means with the leading edge of each sheet beneath the immediately preceding sheet and close behind the leading edge of said preceding sheet and the trailing edge portion of each sheet projecting a short distance behind the trailing edge of said preceding sheet, so that only a short leading end portion of a sheet, between the leading edge of said sheet and the leading edge of the next succeeding sheet, has its bottom face exposed to contact with said stacking conveyor means;

a stop above the stacking conveyor means in the path of said shingled sheets for forming said sheets on said stacking conveyor means into a stack that is generally perpendicular to the plane of the conveyor means;

and vacuum means beneath the stacking conveyor means which is positioned and arranged to draw said short leading end portions of said shingled sheets constantly and firmly downwardly against said stacking conveyor means to subject each leading end portion to a strong conveying force, said vacuum means having a downstream end effectively directly beneath the stop so as to hold each said leading end portion until the leading edge abuts the stop and then release it rapidly as the leading edge of the next succeeding sheet is advanced beneath the leading end portion of the sheet next above it and against said stop, whereby each limp paper sheet is advanced by a strong conveying force beneath said forming stack and against said stop and said conveying force on each sheet is then quickly reduced.

2. The combination of claim 1 in which the stacking conveyor means comprises a plurality of parallel belts, at least one of said belts is perforate, and in which the vacuum means comprises an upward y open vacuum chamber, the top of which is covered by said one of said belts so that air may enter the chamber only through the perforations in the perforate belt.

3. The combination of claim 1 in which the stacking conveyor means comprises a plurality of parallel belt means, and in which the vacuum means communicates with the undersurfaces of the leading end portions of the limp paper sheets in the shingled stream in a plurality of longitudinally extended areas.

4. The combination of claim 3 in which there are parallel longitudinal lines of perforations in the parallel belt means through which the vacuum means communicates with the undersurfaces of the leading end portions of the limp paper sheets in the shingled stream.

5. The combination of claim 1 in which the stacking means comprises a plurality of parallel belts, at least one of said belts which spans the longitudinal median plane of the shingled stream is perforate, and in which the vacuum means comprises an upwardly open vacuum chamber, the top of which is covered by said perforate belt.

6. The combination of claim 1 which includes a driven feedroll which bears upon and frictionally engages the projecting trailing edge portion of each limp sheet sheet as it enters the stack to apply a feeding force to each such sheet which cooperates with the force applied by the advance of the conveyor means to drive each such sheet positively under the stack and against the stop.

* * * * *